US005106083A

United States Patent [19]

Hall

[11] Patent Number: 5,106,083

[45] Date of Patent: Apr. 21, 1992

[54] EXERCISE DEVICE WITH PROTRUSION

[76] Inventor: Henry V. Hall, Star Rte. 62, Box 433, Center Harbor, N.H. 03226

[21] Appl. No.: 625,319

[22] Filed: Dec. 10, 1990

[51] Int. Cl.[5] ..... A63B 21/00; A61F 5/00

[52] U.S. Cl. ..... 482/145; 602/32; 482/141; 482/41

[58] Field of Search ..... 272/144, 145, 93, 134; 128/70–75

[56] References Cited

U.S. PATENT DOCUMENTS

| | | | |
|---|---|---|---|
| 3,493,225 | 2/1970 | Ceraldi | 272/144 X |
| 4,182,511 | 1/1980 | Camp, Jr. | 272/145 |
| 4,292,962 | 10/1981 | Krause | 128/68 |
| 4,319,747 | 3/1982 | Rogers | 272/73 |
| 4,387,894 | 6/1983 | Baumann | 272/130 |
| 4,391,443 | 7/1983 | Beecroft | 272/145 |
| 4,398,713 | 9/1983 | Ellis | 272/145 |
| 4,461,287 | 7/1984 | Takahashi | 128/75 |
| 4,522,391 | 6/1985 | Rundall | 272/62 |
| 4,546,972 | 10/1985 | Goyer | 272/144 X |
| 4,609,193 | 9/1986 | Knipp | 272/145 |
| 4,645,196 | 2/1987 | Christie | 272/144 X |
| 4,690,133 | 9/1987 | George | 272/144 X |
| 4,830,367 | 5/1989 | Foran | 272/145 |
| 4,915,101 | 4/1990 | Cuccia | 128/74 X |
| 4,995,378 | 2/1991 | Dyer et al. | 128/75 |

FOREIGN PATENT DOCUMENTS

| | | | |
|---|---|---|---|
| 0244271 | 11/1987 | European Pat. Off. | 128/75 |
| 0003825 | 6/1988 | World Int. Prop. O. . | |

OTHER PUBLICATIONS

Universal ® Back Extensor, p. 14.
Marcy's Back Extension Station.
Orthopod ®.

*Primary Examiner*—Richard J. Apley
*Assistant Examiner*—Linda C. M. Dvorak
*Attorney, Agent, or Firm*—Michael J. Weins

[57] ABSTRACT

The present invention is for an exercise device for strengthening the muscles of the lower back and a method for using the same. The device has hand rails provided which allow the user to vary the relative involvement of muscles of the lower back. The device has a protrusion with a ridge which supports the pelvic area of the user. Preferably the contour of the ridge is adjustable to ensure the comfort of the user. The device preferably has an ankle retaining means which is adjustable and into which the user's ankles can be slidably engaged with a pivotable motion of the body. This simplifies the positioning of the user on the device.

18 Claims, 6 Drawing Sheets

EXERCISE DEVICE WITH PROTRUSION

FIELD OF THE INVENTION

The present invention relates to an exercise device, and in particular to a device for stretching, strengthening, and relaxing the lower back muscles.

BACKGROUND OF THE INVENTION

There are a variety of devices which are currently available for the exercise of the lower back. One of the difficulties with the present devices is that they are difficult for the user to mount and to gradually regulate the stress applied to the lower back muscles. These problems have, in part, been overcome by U.S. Pat. No. 4,319,747 which provides outwardly extending members which afford some support to the user while positioning himself/herself on the device. However, it does not provide a means for helping the user regulate the stress applied to the lower back muscles during exercise. The '747 and other devices currently available require agility in order to be able to use the devices, and a degree of fitness is required to use the device without over extension of the lower back muscles. Furthermore using current devices for exercising the lower back can result in large compression loads on the lower section of the spine, which may be detrimental to a weakened back. The agility and fitness required of those using the present devices is frequently lacking in persons seeking to overcome a weakness in the muscles of the lower back. Thus there is a need for an exercise device well suited to those with limited agility who need to strengthen the muscles of the lower back.

SUMMARY OF THE INVENTION

It is an object of the invention to provide a back exercise device for strengthening the lower back.

It is another object of the invention to provide a device which can be easily mounted.

It is a further object of the invention to provide a device for use to relieve pain in the lower back.

It is still a further object of the invention to provide a device which allows the user to gradually begin exercising the back muscles.

It is a further object of the invention to provide a device which is used for stretching and relaxing the muscles in the lower back.

It is yet another object of the present invention to provide an exercise device which is collapsible, simplifying storage.

These and other objects of the invention will become apparent from the following description, drawings and claims.

The present invention is for an exercise device which supports the pelvic area of the user and retains the user's ankles. The torso of the user is not directly supported by the device. In its simplest form, the exercise device has a platform bounded by a first end, a second end, and two sides. A protrusion attaches to the first end of the platform. An ankle retaining means engages the platform between the protrusion and the second end. A pair of spaced apart hand rails extends beyond its first end.

The protrusion extends from the platform and is in close proximity to the first end. The protrusion has a free surface that is concave when viewed from the platform. It is preferred that the protrusion is asymmetric, having a first side which is substantially planar and normal to the platform. It is further preferred that the first end of the platform terminates in the plane of the first side of the protrusion. It is further preferred that the second side of the protrusion is curved and has a midsection which is planar or concave when viewed from the platform. The midsection of the second side is about two thirds of the linear length of the second side. The position and curvature of this midsection is such that the tangents thereto intersect the platform at angles between about 57 and 72 degrees. The two sides join forming a ridge. Preferably the ridge is rounded, padded, and so configured to provide comfort to the pelvic area of the user as the user raises and lowers his/her torso, pivoting on the protrusion. It is further preferred that the ridge has raised sections, creating a depression therebetween. The depression prevents undue pressure on the pubis and the femoral arteries when the pelvic area is rested on the ridge of the protrusion. Pressure on the femoral arteries reduces circulation to the legs; by creating a depression substantial reduction in circulation can be avoided. Adjustibility of the raised sections is preferred to accommodate the pelvic area of the particular user. Attachable pads can be employed to provide adjustability.

The spaced apart hand rails are preferably attached to the first end of the platform. They preferably extend beyond the end of the platform and are substantially coplanar with the platform. Hand rails, for the purpose of this patent, shall be defined as any member on which to position the hands of the user allowing the arms to support the weight of the torso. The hand rails extend beyond the first end of the platform a distance comparable to the length of the torso of the user, typically about 24 inches. Having the rails extend a distance at least the length of the torso ensures that the hands can be positioned so that the user can use his/her arms to provide a "push-up" action, allowing the user to regulate the exertion of the muscles in the region of the lower back. This distance will provide sufficient length for comfort of a tall user. The hand rails preferably have a separation in the neighborhood of 18 to 22 inches, which allows the torso to pass therebetween. The hand rails with this separation are not so far apart that the user's arms will not be substantially normal to the user's torso when his/her hands are on the rails.

It is preferred that the platform is padded and that the means for retaining the ankles slidably engages the platform. In one preferred embodiment, two tracks are attached to the sides of the platform between the protrusion and the second end. These tracks are employed to slidably engage the ankle retaining means.

It is further preferred that the means for retaining the ankles is adjustable. The means has a first bar, having a first end and a second end, and a second bar having a first end and a second end. The second bar is spaced apart from the first bar. The first bar is in close proximity to the platform and the second bar is at a distance greater than the distance of the first bar from the platform. The first bar and second bar are spaced apart, creating a slot having a width sufficient to accommodate the passage of the user's ankles. An adjustable connection arm attaches to the first bar in close proximity with the first end of the first bar and to the second bar in close proximity with the first end of the second bar. It is preferred that the first and second bars are padded.

The platform, as described above, can be positioned on a support surface such as a bed, chair, or bench.

When the platform is so positioned, stability can be provided either by affixing the platform to the support surface or alternatively by supporting the hand rails with support bars.

In a further preferred embodiment, a base is attached to the platform. The hand rails employed for this embodiment can be made an integral part of the base. The base raises the platform off the floor, allowing the user to lower the torso below the level of the platform.

BEST MODE FOR CARRYING THE INVENTION INTO PRACTICE

Figure 1:
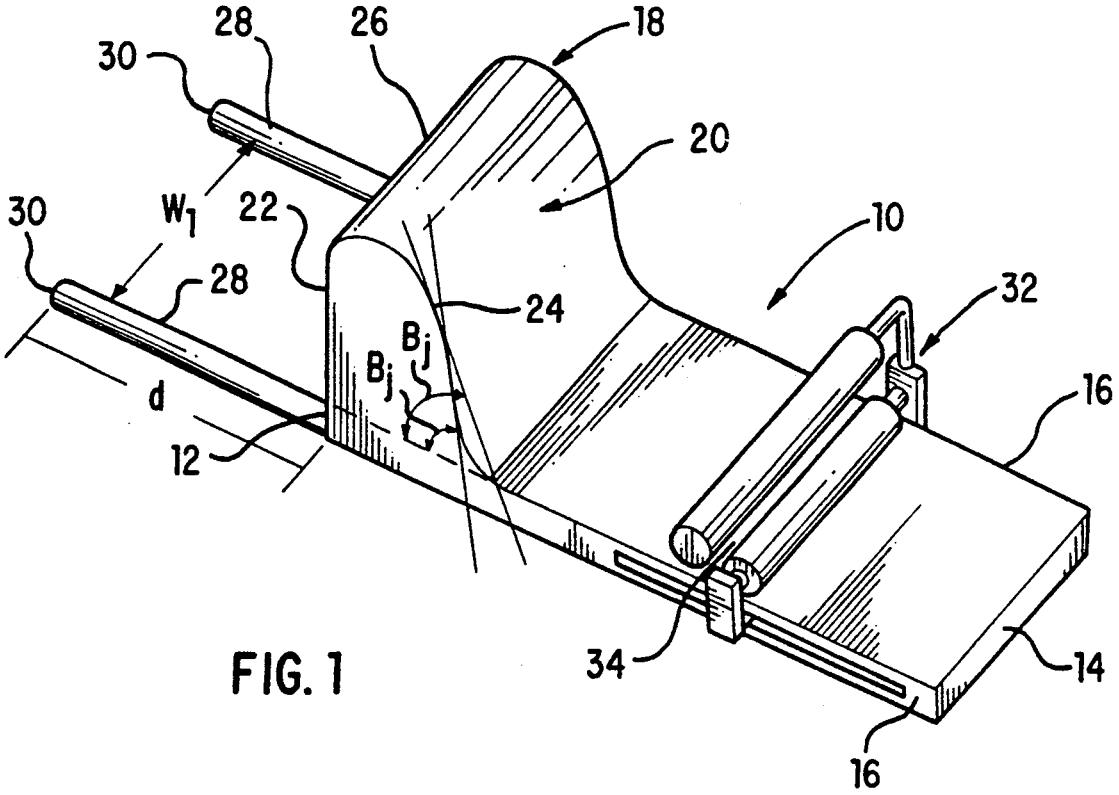
FIG. 1 is a perspective view of one embodiment of the exercise device of the present invention.

FIG. 1 illustrates one embodiment of the exercise table of the present invention. A platform 10 is provided to support the user. The platform 10 is preferably padded. The platform 10 is bounded by a first end 12, a second end 14, and two sides 16. A protrusion 18 extends from the platform 10 and is in close proximity to the first end 12. The protrusion 18 has a free surface 20 that is concave when viewed from the platform 10. It is preferred that the protrusion 18 is asymmetric, having a first side 22 that is substantially planar and is normal to the platform 10. It is further preferred that the first end 12 of the platform 10 terminate in the plane of the first side 22 of the protrusion 18.

It is also further preferred that the protrusion 18 has a second side 24 which is curved and has a midsection $m_s$ which is planar or concave when viewed from the platform 10. The midsection $m_s$ of the second side 24 is about two thirds the linear length of the second side 24. The positioning and curvature of the midsection of the second side is such that the tangents thereto intersect the platform 10 at angles $\beta_j$, between about 57 and 72 degrees. The first side 22 and the second side 24 join to form a ridge 26. Preferably the ridge 26 is rounded and has a padded surface to reduce the pressure on the pelvic area of the user when the user is positioned on the platform 10 for performing the back strengthening exercises.

A pair of spaced apart hand rails 28 extend beyond the first end 12 of the platform 10. The rails 28 are substantially coplanar with the platform 10. The hand rails 28 terminate in free ends 30 at a distance d from the first end 12 of the platform 10. The distance d is at least the length of the torso of the average user, typically the distance d is at least about 24 inches. Having the hand rails 28 extend this distance d allows the user to use his/her arms to provide a "push-up" action, thereby allowing the user to regulate the extension of the muscles in the region of the lower back. This preferred minimum distance d of the hand rails 28 will provide sufficient length for comfort of a tall user. The hand rails 28 have a separation width $w_1$ of about 18 to 22 inches, which is a separation such that the torso of the user can pass therebetween while assuring that the arms of the user will remain substantially normal to the torso.

An ankle retaining means 32 has a slot 34 therein for placement of the user's ankles. The ankle retaining means 32 engages the platform 10 between the protrusion 18 and the second end 14.

Figure 2:
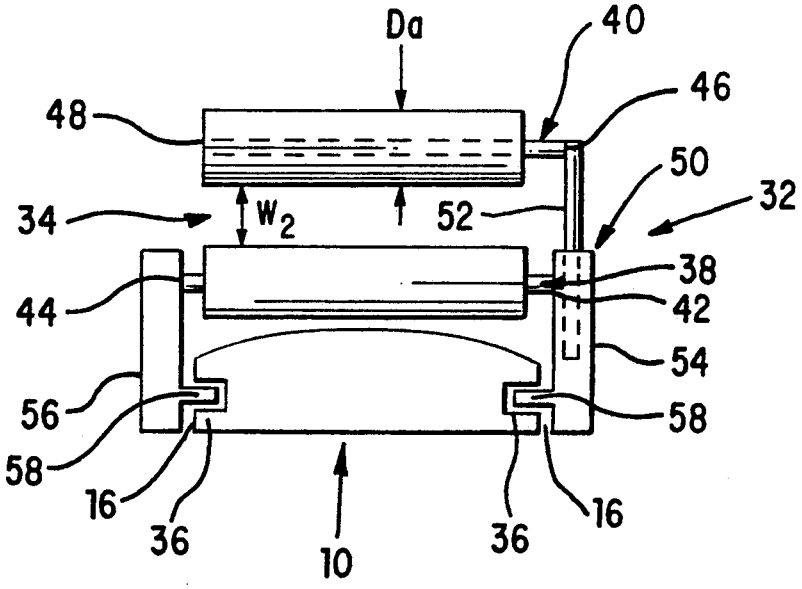
FIG. 2 is a sectional view of a means for retaining the ankles which holds the ankles of the user in a fixed position during the course of the exercises.

FIG. 2 shows a sectional view of the preferred embodiment of the ankle retaining means 32 which is adjustable to accommodate the ankles. The ankle retaining means 32 is adjustable both with respect to the protrusion 18 and the slot 34 into which the ankles of the user are placed while the back is being exercised. A pair of tracks 36 is provided along the sides 16 of the platform 10. The ankle retaining means 32 slidably engages the tracks 36.

The slot 34, as illustrated in the preferred embodiment of FIG. 2, is bounded by a first bar 38 in close proximity to the platform 10 and a second bar 40 spaced apart from the first bar 38 and at a distance greater than the distance of the first bar 38 from the platform 10. The second bar 40 can be adjusted with respect to the first bar 38 to change the width $W_2$ of the slot 34. The first bar 38 has a first end 42 and a second end 44. The second bar 40 has a first end 46 and a second end 48. An adjustable connection arm 50 attaches to the first end 42 of the first bar 38 and the first end 46 of the second bar 40. The slot 34 can be adjusted to provide a width $w_2$ sufficient to accommodate the passage of the user's ankles. The ankle retaining means 32, with the slot 34 which is open on one end is the preferred ankle retaining means. Having the ankle retaining means so configured allows the user to pivot and slide both ankles into the slot. Pivoting on the knees allows the user to position himself/herself with minimal strain on the back. It is preferred that the first bar 38 and second bar 40 be padded for the comfort of the user. It is further preferred that the diameter $D_a$ of the second bar 40 be at least 5 in. to reduce the pressure on the back of the ankles when the user is exercising.

In the embodiment of FIG. 2, the adjustable connection arm 50 has a first adjustable arm segment 52 and a second adjustable arm segment 54. The first end 46 of the second bar 40 is attached to the first adjustable arm segment 52. The first end 42 of the first bar 38 is attached to the second adjustable arm segment 54, and the second end 44 of the first bar 38 is attached to a brace 56. The brace 56 and the second adjustable arm segment 54 have tabs 58 attached, and the tabs 58 engage the track 36.

Figure 3:
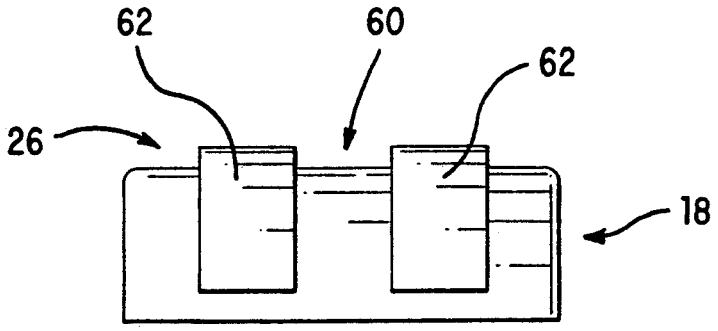
FIG. 3 is a view of a preferred protrusion having a ridge with raised sections. The raised sections are adjustable with respect to the ridge providing an adjustable central depression.

FIG. 3 shows a preferred embodiment of the protrusion 18 where a depression 60 is provided in the central portion of the ridge 26 to accommodate the pubis of the user when the user is supported on the ridge 26 of the protrusion 18. In one preferred embodiment the depression 60 is created by spaced apart pads 62. The pads 62 reduce the pressure on the pubis and the femoral arteries. Reducing the pressure on the pubis provides additional comfort to the user. Reducing the pressure on the femoral arteries prevents circulation problems in the legs. The spaced apart pads 62 can be positioned at various locations along the ridge 26 of the protrusion 18. Preferably the pads 62 are attached with a hook and pile fastener, such as Velcro® closures providing adjustability of the separation of the pads 62 to tailor the support to the anatomy of the individual user.

Figure 4:
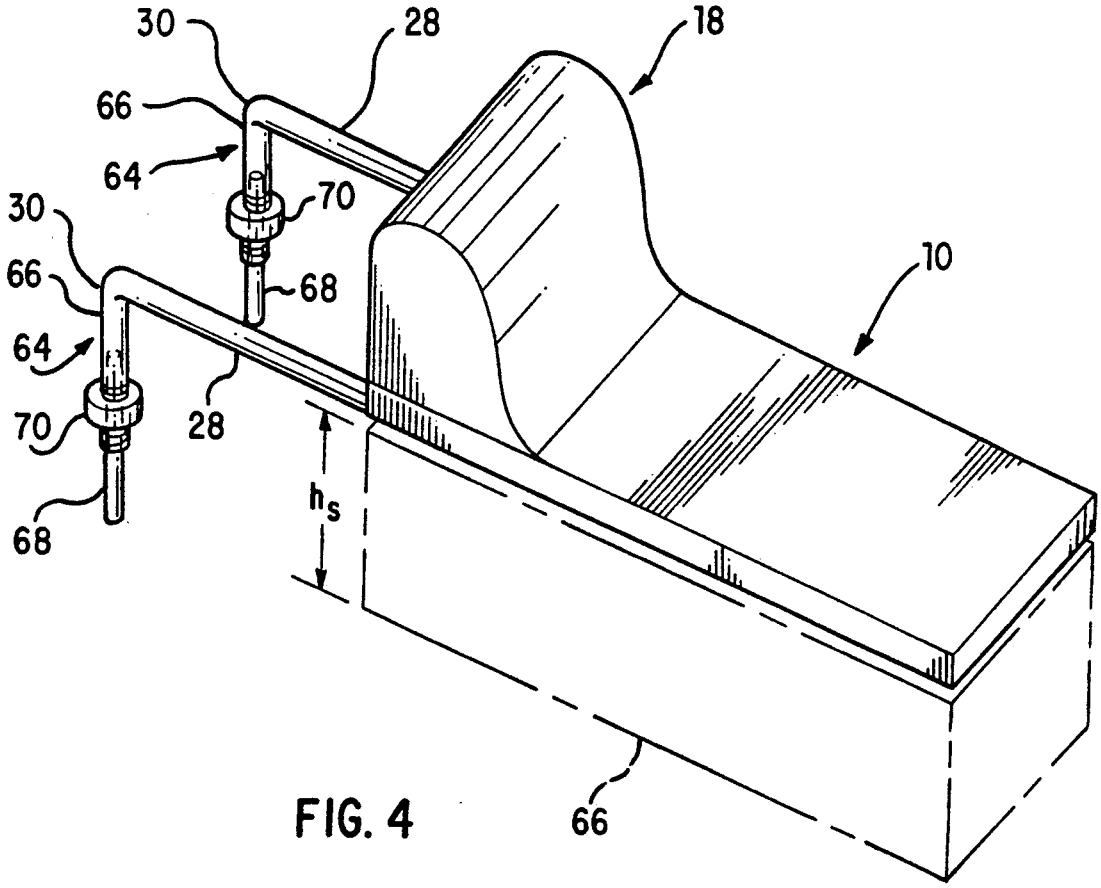
FIG. 4 shows an embodiment of the exercise device shown in FIG. 1 with support bars attached to the hand rails and where the platform is supported on a raised surface such as a bed or chair.

The platform 10 must be raised so that the user can lower the torso below the level of the platform 10. The platform 10 can be placed on a support surface illustrated by the phantom line image in FIG. 4. Beds, chairs and benches can be employed as the support surface. The raised platform 10 can be stabilized by affixing the platform 10 to the support surface or alternatively by a pair of support bars 64, which are attached to and are substantially normal to the hand rails 28. The support bars 64, as shown in FIG. 4, are attached to the rails 28 near the free ends 30. Preferably the length of the support bars 64 is adjustable so it can be matched to the height $h_s$ of the support surface 66 shown by the phantom lines. Adjustability for the embodiment shown in FIG. 4 is provided by having the support bars 64 constructed in two sections. A first section 66 attaches to the hand rails 28 while the second section 68 slidably engages the first section 66, forming a telescoping leg. Locking coupling 70 affixes the two legs sections relative to each other.

Figure 5:
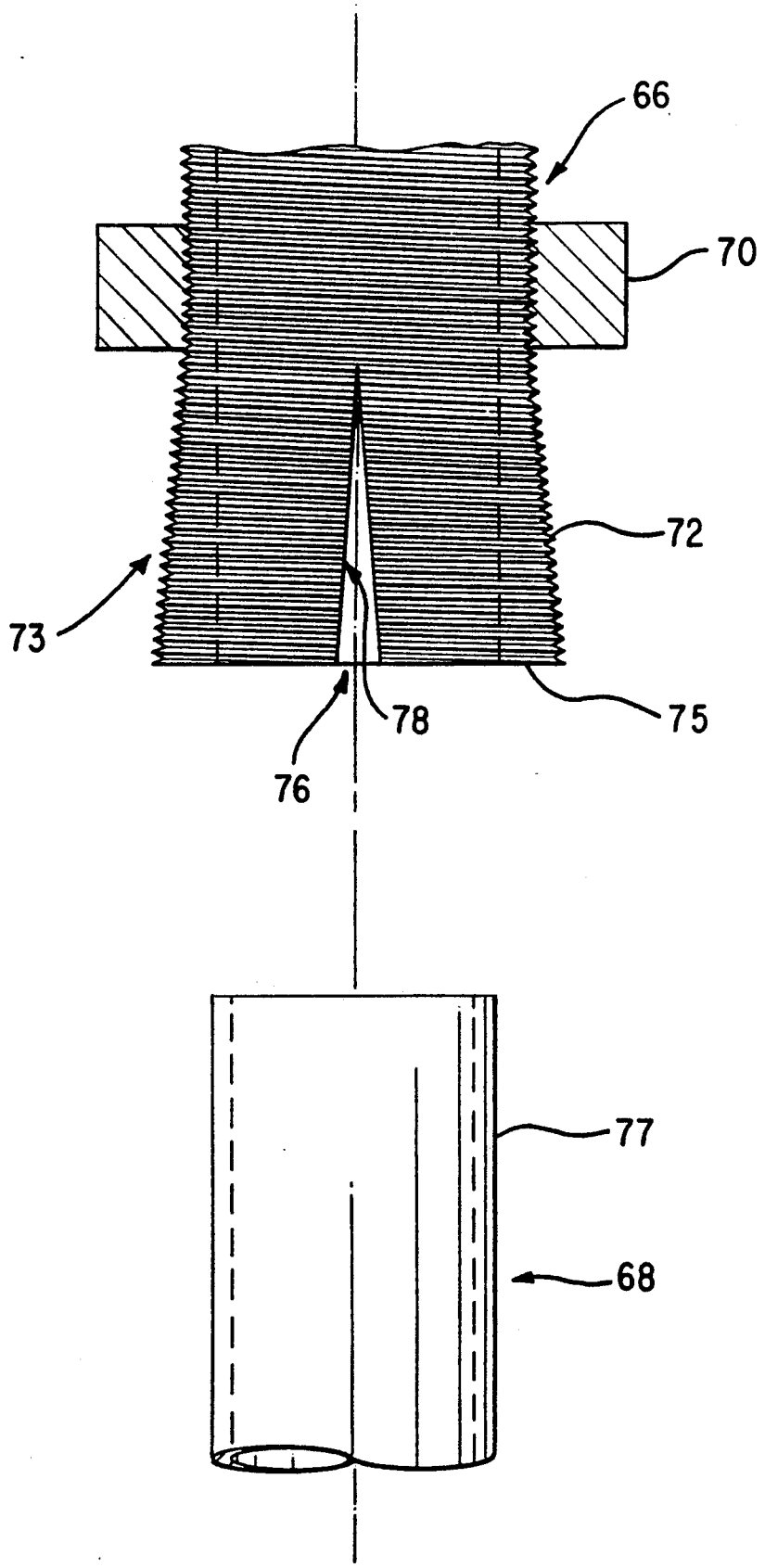
FIG. 5 illustrates details of a locking means for the coupling sections of support bars which attach to the hand rails of the exercise device of the present invention.

FIG. 5 illustrates one locking coupling 70 suitable for securing the first section 66 to the second section 68. The first section 66 has a wall of variable thickness and has threads 72 on the exterior surface 73. The threads 72 engage the locking coupling 70. As the locking coupling 70 is advanced toward the free end 75 of the first section 66 the radius of the central opening 76 is reduced. Reducing the radius of the central opening 76 causes the first section 66 to grip the wall 77 of the second section 68 of the legs 64. The locking coupling 70 can be advanced to a position where the fit between the first section 66 and the second section 68 is snug. The friction between the two sections will hold them in position. A slit 78 is provided in the first section 66 to allow the radius of the opening 76 to be reduced.

Figure 6:
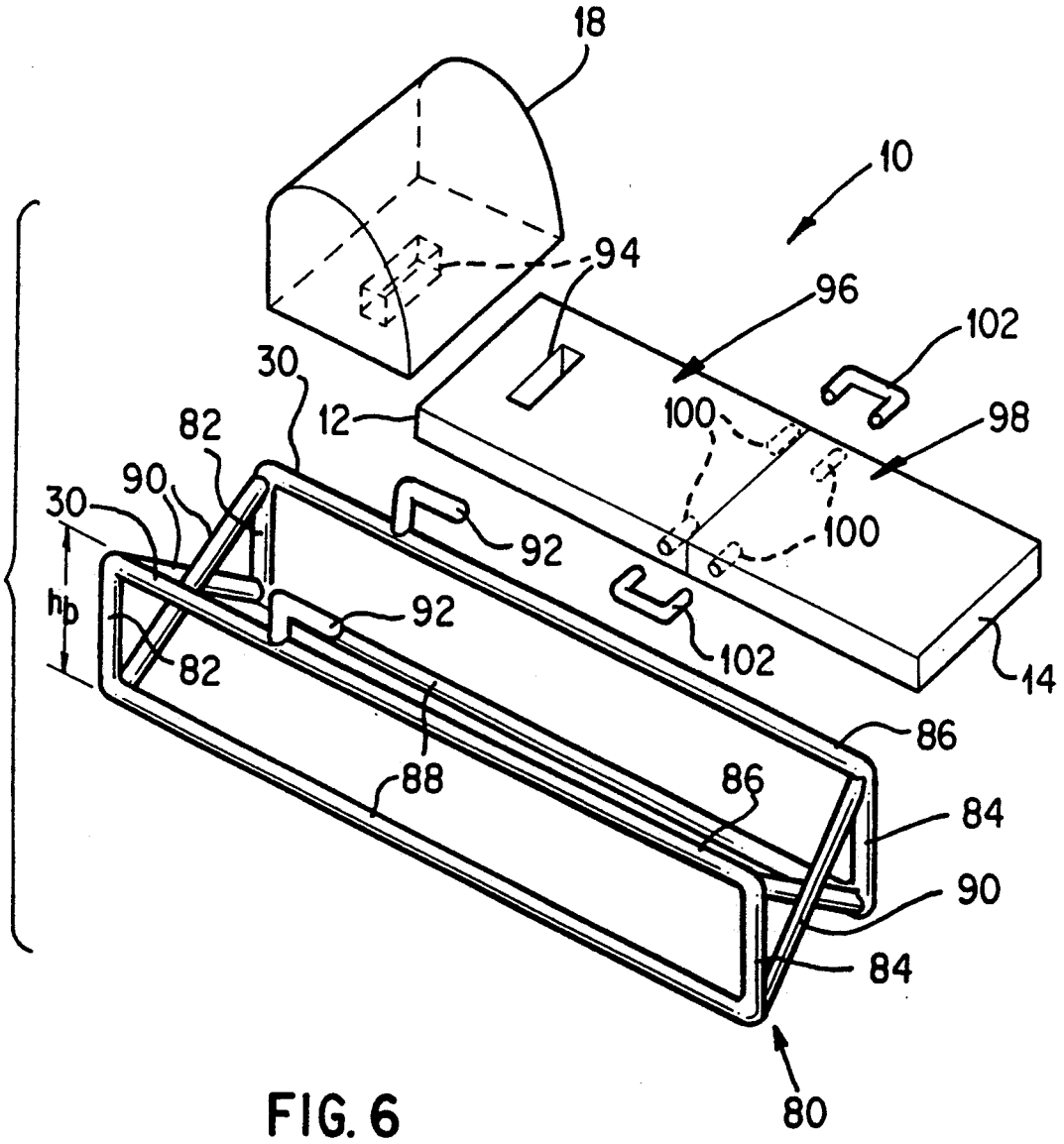
FIG. 6 is the preferred embodiment of the exercise device of FIG. 1 with an attachable base having the hand rails an integral part thereof. The platform is sectional and the protrusion separable so the exercise device can be collapsed.
Figure 7:
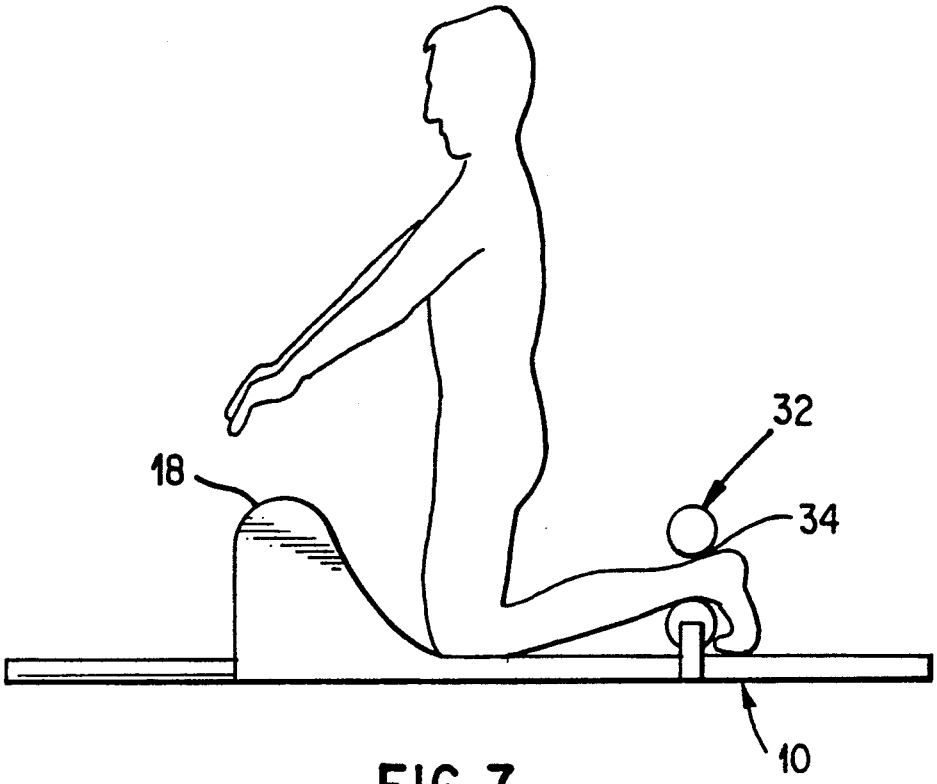
FIGS. 7 through 11 show a preferred method using the exercise device. It illustrates mounting and exercising, beginning with minimal strain on the back and gradually increasing the load on the back muscles as strength increases.

FIG. 6 shows another embodiment of the exercise device where the platform 10 is supported on a base 80. The platform 10 mounts on the base 80, which preferably has a height $h_b$ between about 18 inches and 22 inches, and allows easy mounting by kneeling down on the platform 10. This height also provides sufficient distance above the floor level for the user to lower his upper body below the level of the platform 10 during exercise The base 80, as shown in FIG. 6, has two front legs 82, two rear legs 84, and two upper rails 86 which connect the front legs 82 to the rear legs 84 and support the platform 10. These upper rails 86 are longer than the platform 10 and extend beyond the front end 12 of the platform 10. The portion of the upper rails 86 that extends beyond the platform 10 forms the hand rails 30. Two lower rails 88 also connect the front legs 82 to the rear legs 84, stabilizing the legs. The front legs 82 and the rear legs 84 are connected to one another with crossing support rails 90, providing additional strength and stability to the base 80.

FIG. 6 also shows a preferred embodiment where there are two positioning rails 92 located on either side of the protrusion 18. The positioning rails 92 are above the level of the hand rails 30 so that they can be used while the user is positioning his/her pelvis on the protrusion 18, thereafter lowering the hands to the hand rails 30. The positioning rails 92 are connected to the upper rails 86 of the base 80.

The embodiment shown in FIG. 6 is collapsible for ease of storage. The protrusion 18 is separable from the platform 10. The protrusion attaches to the platform with a tongue and groove coupling 94. Again to reduce the size for storage, the platform 10 is made in two sections. The platform 10 has a first section 96, which includes the first end 12, and a second section 98 which includes the second end 14. The sections are joined by a coupling means therebetween. A variety of coupling means can be employed. One simple method of coupling the first section 96 to the second section 98 is to provide holes 100. For placement into the holes are U shaped connectors 102 which slidably engage the holes 100.

Figure 8:
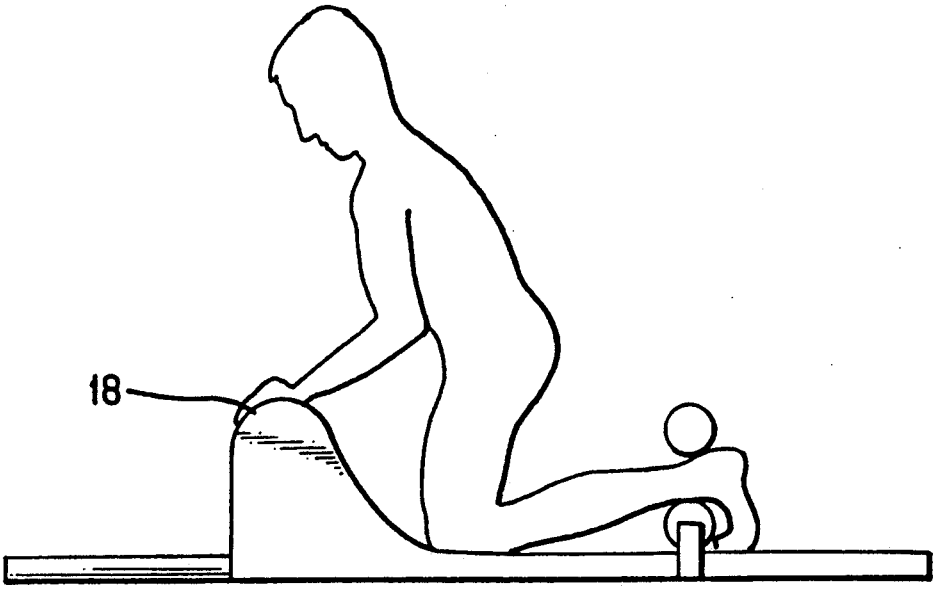
Figure 9:
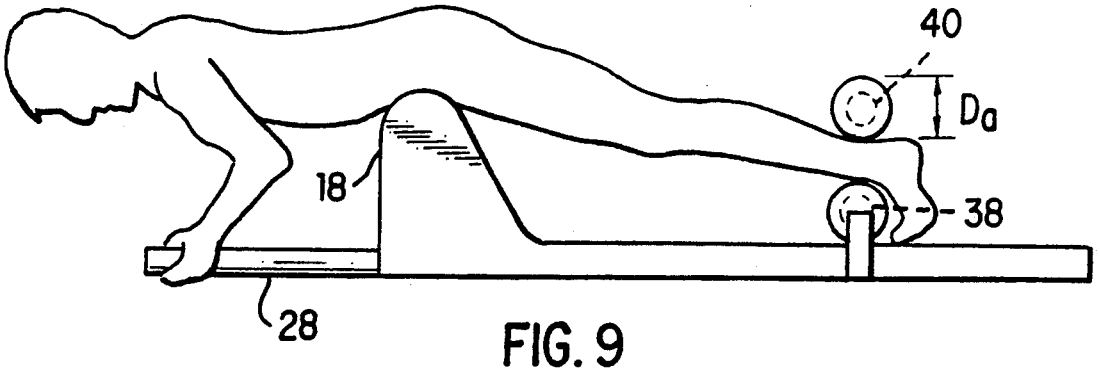
Figure 10:
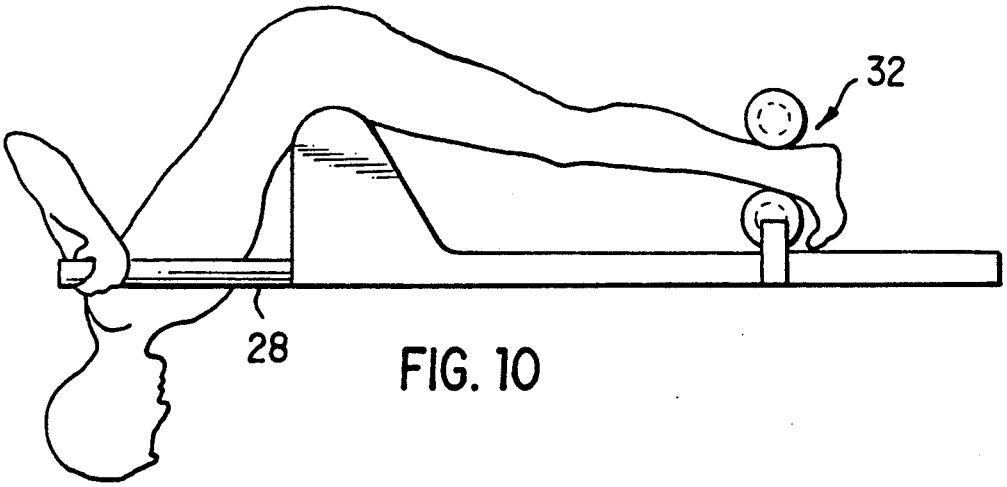

FIGS. 7 through 11 show the preferred method for mounting and using the exercise device of the present invention. With the preferred design of the present invention the bench will have a height such that the user can easily mount and the user can position himself/herself kneeling on the platform 10. The user pivots on his/her knees, turning to face the protrusion 18, and slides his/her ankles into the slot 34 in the ankle retaining means 32. The user is then in the position shown in FIG. 7. The user can then lower himself/herself into the exercise position by a three stage process. In the first stage the hands can be placed on the protrusion 18 or, if provided, on the positioning rails 92 (shown in FIG. 6) starting the body's forward motion, as shown in FIG. 8. The forward motion continues until the upper portion of the body rests on the protrusion 18. The hands are then placed on the pair of hand rails 28, and the user slides his/her body forward on the protrusion 18 until the pelvic area rests on the protrusion 18. The shoulders and upper portion of the body are substantially horizontal, as shown in FIG. 9. In this position, the back of the ankles of the user rest on the second bar 40 for the comfort of the user. The first bar 38 and the second bar 40 should be padded, and preferably the padded diameter $D_a$ of the second bar 40 should be at least 5 inches, so as to distribute the pressure on the back of the ankles. The user lowers his/her shoulders, with the assistance of the arms, until the torso approaches a vertical position, as shown in FIG. 10.

Allowing the body to hang limp, as shown in FIG. 10, helps to stretch the muscles and extend the vertebrae in the lower back. With the ankles secure in the ankle retaining means 32 and the hands grasping the pair of rails 28, the user can begin to raise and lower his/her torso with the strength of his/her arms and little use of the back muscles. The user can gradually decrease the amount of load born by the arms, thereby gradually increasing the amount of stress applied to the back muscles. This will allow the muscles to be gradually subject to increased loads.

Figure 11:
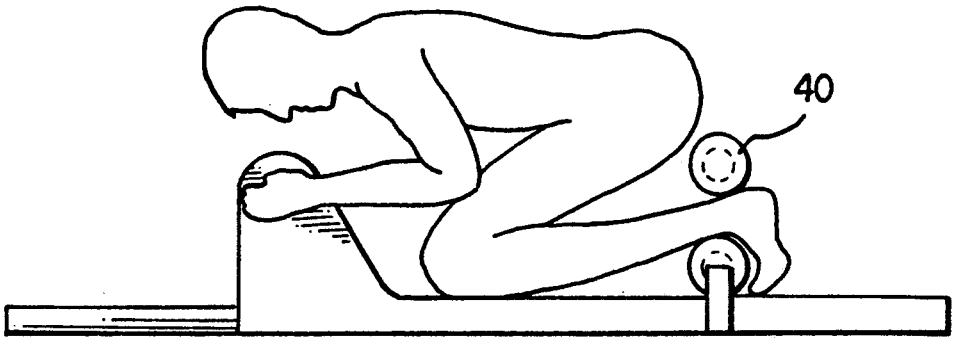

After the exercise has been completed it is preferred that the user rest in a crouched position with the buttocks supported on the second bar 40 of the ankle retaining means 32 as is shown in FIG. 11. Before dismounting the user can relax the back muscles by resting in the position shown in FIG. 11.

While the preferred embodiment of the invention has been described, it should be apparent to one having ordinary skill in the art that many modifications or changes may be made in the preferred embodiment without departing from the spirit of the present invention as expressed by the scope of the appended claims.

What I claim is:

1. An exercise device for exercising the lower back of an individual, the device supporting the lower portion of the individual's body by retaining the ankles and supporting the pelvic area while not directly supporting the torso, the device comprising:

an elongated and substantially planar platform bounded by a first end, a second end, a first side, and a second side;

a protrusion extending from said platform in close proximity to said first end of said platform, said protrusion adapted to support the pelvic area and to provide a pivot point for the torso with respect to the supported lower portion of the body, retaining means including means for adjustably retaining the individual's ankles, said said retaining means engaging said platform between said protrusion and said second end of said platform; and a pair of hand rails substantially coplanar with said platform and having a separation sufficient for the torso to pass therebetween, said pair of hand rails extending beyond said first end of said platform a distance comparable to the length of the torso.

2. The exercise device of claim 1 further comprising:

a pair of positioning rails located above said platform and beside said protrusion.

3. The exercise device of claim 1 wherein said means for holding the ankles comprises:

a first bar having a first end and a second end;

a second bar having a first end and a second end, said first bar being spaced apart from said second bar, and said first bar being in close proximity to said platform, said second bar being at a distance greater than said first bar from said platform; and a connection arm attached to said first end of said first bar and said first end of said second bar.

4. The exercise device of claim 3 wherein said connection arm is adjustable.

5. The exercise device of claim 4 wherein said means for holding the ankles slidably engages said platform.

6. The exercise device of claim 1 wherein said protrusion is asymmetric and said protrusion further comprises:

a ridge;

a first side adjoining said ridge, said first side forming a plane substantially normal to said platform and said first end of said platform terminating in said first side; and a second side adjoining said ridge, said second side being curved and concave when viewed from said platform, said second side having midsection $m_s$ which is about two thirds of the linear length of said second side, said midsection having tangents to the surface which intersect said platform at angles $\beta_j$, where $\beta_j$ are between 57 and 72 degrees.

7. The exercise device of claim 6 wherein said means for holding the ankles further comprises:

a first bar having a first end and a second end;

a second bar having a first end and a second end, said first bar being spaced apart from said second bar, and said first bar being in close proximity to said platform, said second bar being at a distance greater than said first bar from said platform; and a connection arm attached to said first end of said first bar and said first end of said second bar.

8. The exercise device of claim 7 wherein said connection arm is adjustable.

9. The exercise device of claim 8 wherein said means for holding said ankles slidably engages said platform.

10. The exercise device of claim 5 wherein said protrusion is separable from said platform.

11. The exercise device of claim 10 wherein said platform further comprises:

a first section including said first end;

a second section including said second end; and means for coupling said first section to said second section.

12. The exercise device of claim 11 wherein said device further comprises:

a pair of support bars attached to said hand rails and substantially normal to said hand rails; and means for adjusting said support bars.

13. The exercise device of claim 9 further comprising a base on which said platform is supported.

14. The exercise device of claim 11 further comprising a base on which said platform is supported.

15. The exercise device of claim 6 wherein said ridge has a first raised section and a second raised section creating a depression therebetween.

16. The exercise device of claim 15 wherein a first pad and a second pad provide said raised sections.

17. The exercise device of claim 5 wherein said second bar has a bar pad with a diameter of at least 5 inches.

18. The exercise device of claim 1 wherein said protrusion has a first side and a second side so positioned with respect to each other as to create an asymmetric protrusion with said first side being substantially normal to said platform.

* * * * *